US007121052B2

(12) United States Patent
Niese et al.

(10) Patent No.: US 7,121,052 B2
(45) **Date of Patent: *Oct. 17, 2006**

(54) PANEL-TYPE SUBFLOOR ASSEMBLY FOR ANCHORED/RESILIENT FLOOR

(75) Inventors: Michael W. Niese, Cincinnati, OH (US); Paul W. Elliot, Salem, IN (US); John Richard Puening, Cincinnati, OH (US)

(73) Assignee: Robbins, Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/113,732

(22) Filed: Apr. 25, 2005

(65) Prior Publication Data

US 2005/0193670 A1 Sep. 8, 2005

Related U.S. Application Data

(63) Continuation of application No. 10/447,903, filed on May 29, 2003, now Pat. No. 6,883,287.

(51) Int. Cl.
*E04F 15/22* (2006.01)

(52) U.S. Cl. ..... 52/403.1; 52/480; 52/506.05; 52/512

(58) Field of Classification Search ..... 52/480, 52/506.05, 506.06, 506.08, 512, 403.1
See application file for complete search history.

(56) References Cited

U.S. PATENT DOCUMENTS 1,649,842 A 11/1927 McBride
3,511,001 A 5/1970 Morgan, Jr.
4,759,164 A * 7/1988 Abendroth et al. ..... 52/403.1
4,910,936 A * 3/1990 Abendroth et al. ..... 52/403.1
5,016,413 A 5/1991 Counihan
5,365,710 A 11/1994 Randjelovic
5,369,927 A 12/1994 Counihan
5,412,917 A 5/1995 Shelton
5,609,000 A 3/1997 Niese
5,647,183 A 7/1997 Counihan
5,682,724 A 11/1997 Randjelovic
5,778,621 A 7/1998 Randjelovic
5,906,082 A * 5/1999 Counihan ..... 52/403.1
6,055,785 A 5/2000 Counihan
6,073,409 A 6/2000 Chambers
6,115,981 A 9/2000 Counihan
6,122,873 A 9/2000 Randjelovic
6,158,185 A * 12/2000 Counihan ..... 52/403.1
6,688,065 B1 2/2004 Chambers

* cited by examiner

*Primary Examiner*—Naoko Slack
(74) *Attorney, Agent, or Firm*—Wood, Herron & Evans, LLP

(57) ABSTRACT

A panel-type subfloor assembly for an anchored/resilient floor includes a plurality of elongated panels laid end-to-end in parallel rows along a first direction, the panels having elongated slots formed therein that are oriented at an oblique angle relative to the first direction. For the entire floor, this results in a plurality of aligned rows of elongated slots oriented at an oblique angle relative to the first direction. Each slot cooperates with an elongated fastener, namely an elongated dual flanged channel held by at least one pin. The fastener is positioned within the respective slot and adapted to hold the respective panel to the base along two longitudinal edges of the slots, in a manner that limits upward movement of the panel while permitting downward deflection.

18 Claims, 7 Drawing Sheets

PANEL-TYPE SUBFLOOR ASSEMBLY FOR ANCHORED/RESILIENT FLOOR

CROSS-REFERENCE TO RELATED APPLICATIONS

This application is a continuation of U.S. patent application Ser. No. 10/447,903 filed on May 29, 2003 by Michael W. Niese et al. (now U.S. Pat. No. 6,883,287), which application is incorporated herein in its entirey.

FIELD OF THE INVENTION

The present invention relates to hardwood floors, and more particularly to an anchored/resilient floor with a panel-type subfloor that provides strong structural integrity and reduces susceptibility to lateral sheer forces.

BACKGROUND OF THE INVENTION

Wood floors remain popular for athletic facilities, particularly for basketball floors. In a typical hardwood floor, a wear layer of floorboards resides over a base, with a subfloor residing below the wear layer and above the base, and resilient pads residing between the subfloor and the base. The pads create space between the floor and the base, thereby minimizing moisture ontake by the subfloor or the floorboards, which are usually made of wood. The pads also provide a degree of cushioning, or resilience, for the floor. This minimizes the chances of athletic injury due to impact, and reduces wear and tear on the joints of athletes. If the structure does not include some mechanism for attachment to the base, the floor is said to be "free floating" relative to the base.

In some cases it is desirable to secure, or anchor, the floor to the base, primarily for better stability and also to minimize the potentially adverse effects of floorboard expansion and contraction. Such expansion and contraction can occur as a result of moisture ontake and/or egress that is caused by variations in humidity levels as the seasons of the year change. This moisture-caused expansion and contraction of floorboards adversely affects the performance uniformity of the floor. Thus, anchoring the floor helps to assure stability and uniformity in performance.

These dual objectives, to resiliently support the floorboards above the base and to anchor the floorboards to the base, are not easy to simultaneously achieve. Nonetheless, applicant has been successful in simultaneously achieving these dual objectives for several different types of hardwood floors. More specifically, U.S. Pat. No. 5,388,380, entitled "Anchored/Resilient Sleeper for Hardwood Floor System" discloses several anchoring arrangements for anchoring subfloor nailing strips to a base, with the nailing strips supported on pads above the base and anchored in a manner that does not pre-compress the pads beyond a static position. Also, U.S. Pat. No. 5,609,000, entitled "Anchored/Resilient Hardwood Floor System," discloses additional structural variations that also simultaneously achieve these countervailing objectives.

For these types of floors, as perhaps with all floors, or perhaps any consumer products, there remains a high customer demand for better or equal performance at the same or at lower cost. In the floor business, this means that the customer desires a floor of high structural integrity at the lowest reasonable cost. For the floor supplier, this translates to an objective of supplying a floor of high structural integrity but with shorter installation time, easier handling and manufacture of the floor components, and also fewer floor components, but without adversely impacting the other attributes of the floor, such as anchoring and resiliency.

SUMMARY OF THE INVENTION

The present invention achieves the above-stated objects via a panel-type subfloor for an anchored/resilient floor, wherein panels of the subfloor include a plurality of discontinuous, but elongated slots oriented perpendicular to the upper floorboards. For each slot, an elongated fastener, namely a pin-anchored U-shaped channel with two elongated, oppositely directed flanges, cooperates with the respective slot to hold the respective panel along internal edges at a desired distance above the base. The slots are counterbored so as to be oversized longitudinally and transversely relative to the elongated slots, and only one anchor pin is used per channel.

This panel-type subfloor provides a degree of structural integrity for the floor by holding the panels along two opposite ends of each of the slots. The hold-down forces are stronger than other panel-type floors held along only one edge. Also, the cooperative interaction between the slots and fasteners, including the size, shape and use of one pin per channel, gives the floor a "self-alignment" capability. This means that the fasteners are able, to some extent, to reorient themselves in response to lateral sheer forces, forces that inevitably occur with all installed floors. However, this reorientation, or self-alignment, does not adversely impact the hold-down capability of the pins or the resilience of the floor.

Stated another way, another primary benefit of the present invention is the floor's greater tolerance to lateral movement. In one respect, the vertical sidewalls of the fasteners may flex to absorb lateral torsion forces. Thus, the invention accommodates greater downward and lateral forces, while imparting less stress to the fastening structure. The present invention also requires less shimming than several commercially available anchored/resilient panel-type floors.

Also, the use of elongated fasteners within elongated slots, with one pin per channel, simplifies installation and reduces the total number of floor components. For example, the total number of anchor pins and the labor costs associated with installing the anchor pins are significantly reduced.

Most of the components of the floor according to this invention are standard and readily available. For instance, the panels may be made of standard plywood, even in lengths of up to eight feet or longer. The longer the subfloor panels, the easier and more expedient the installation, resulting in lower labor costs. The invention is particularly advantageous when the upper wear layer comprises standard parallel rows of end-to-end floorboards, but the invention could also be used with other floor surfaces.

The subfloor is held above the base by a spacer layer. This spacer layer may be a finite number of resilient pads. Alternatively, and preferably, the spacer layer includes a flat panel-like pad of compressible material that is rolled out across the entire base. To cover substantially all of the base, these pads will also be arranged end-to-end in parallel rows.

According to one embodiment of the invention, the panels are arranged at oblique angles relative to the upper floorboards of the wear layer. The oblique angle of the panels relative to the upper floorboards achieves cross lamination and promotes structural integrity for the overall floor. The rows of elongated slots are further aligned obliquely with respect to the direction of the panels. In this embodiment, the panels are arranged in end-to-end parallel rows in a longitudinal first direction over the top of the spacer layer. As such, the laid-in-place subfloor results in a plurality of parallel rows of elongated slots that are oriented at an oblique angle relative to the first direction. Notably, this oblique angle will also be perpendicular to the longitudinal direction of the upper rows of floorboards, if standard elongated floorboards are used for the wear layer.

If one or more of the panels has more than one slot, preferably the ends of the slots for any given panel will not be contiguous along the longitudinal direction of the floorboards. Alternatively or additionally, it may be desirable to transversely space the panels. Also if desired, an elongated slot may comprise two open-ended slot portions of adjacently located panels. With this structure, the elongated fastener spans between and secures two panels, thereby helping to assure continuity and uniform resiliency. According to another preferred embodiment of the invention, the elongated slots may be oriented parallel, or in alignment with, the longitudinal direction of the panels. This structure would simplify installation.

During installation, after placement of the spacer layer and the subfloor panel layer, the elongated U-shaped fasteners are placed in the slots. Once placed, the fasteners rest directly on the compressible panel-type pad, and for each channel the longitudinal flanges contact the two spaced longitudinal counterbored ledges of the respective slot. Because of their shape, the fasteners are not susceptible to falling over. They remain in place. Thereafter, the fasteners are pinned, or anchored to the base via anchor pins that are driven through the bottoms of the fasteners and into the base, preferably with only one anchor pin per channel. Thereafter, the wear layer is secured to the subfloor. If the wear layer comprises elongated floorboards, the floorboards are nailed in place or otherwise secured in an orientation that is perpendicular to the slots, as is known in the industry.

Compared to prior anchored/resilient floors, and particularly panel-type anchored/resilient floors, the floor of this invention achieves high stability and strength, but with significantly less material and at lower cost. When the floorboards are secured to the subfloor panels with the nailing strips secured to the lower panel, the combined structure has a cross-lamination effect, particularly if the panels are oriented at an oblique angle. Where desired, the structure may have a height profile of under about two inches. Thus, the invention achieves a high strength floor with a relatively low material cost.

These and other features of the invention will be more readily understood in view of the following detailed description and the drawings.

DETAILED DESCRIPTION OF THE PREFERRED EMBODIMENTS

Figure 1:
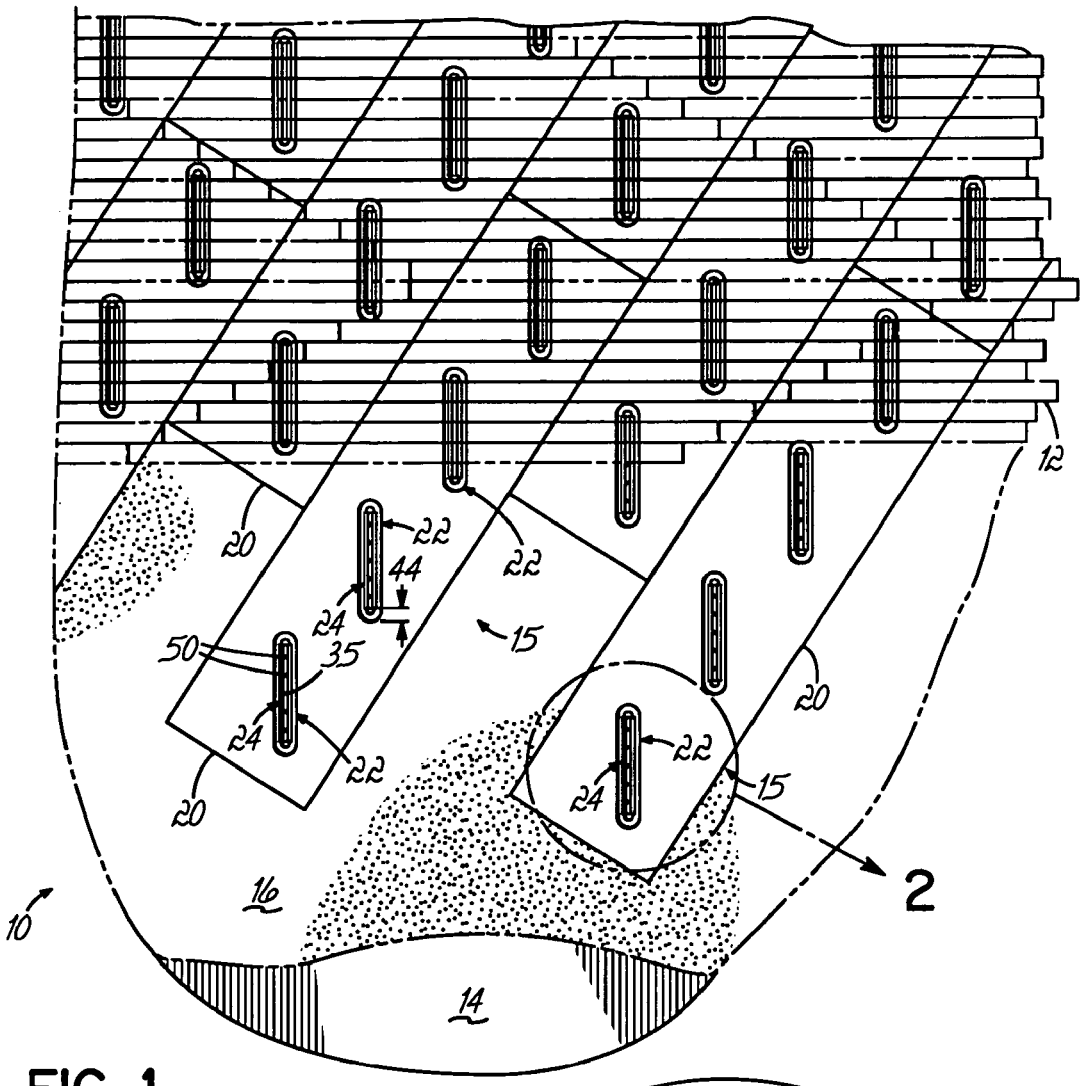
FIG. 1 is a plan view, partially broken away, showing an anchored/resilient floor according to a first preferred embodiment of the invention.
Figure 2:
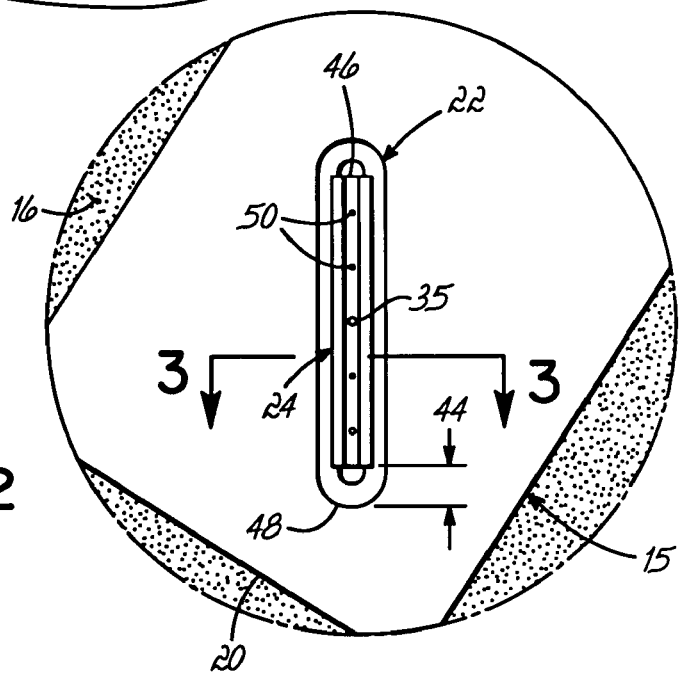
FIG. 2 is also a plan view, showing the subfloor layer of FIG. 1 in greater detail.

FIG. 1 shows a plan view of a floor 10 constructed in accordance with a first preferred embodiment of the invention. The floor 10 includes an upper wear layer 12, which may be tongue and groove floorboards extending end-to-end in parallel rows across a lower base 14. In FIG. 1, the view is along the length of the floor, i.e. from one basket toward the other. A subfloor layer 15 comprising a plurality of panels 20 resides below the wear layer 12. The panels 20 are also arranged end-to-end in parallel rows. However, the rows of panels 20 are oriented along an axis that resides at an angle of about 60° relative to the floorboards of the wear layer 12. The wear layer 12 is supported in spaced relation above the base 14, with a spacer layer 16 and the subfloor layer 15 residing therebetween. In FIGS. 1 and 2, the spacer layer 16 comprises a compressible panel-like pad or carpet.

In one sense, each of the panels 20 is essentially a part of a subfloor assembly 15 that includes the respective subfloor panel 20. The subfloor assembly 15 further includes at least one discontinuous, elongated slot 22 formed within the panel 20 and oriented at about a 30° angle relative to the length and/or grain of its respective panel 20. As such, assembly 15 includes an elongated fastener 24 located within the elongated slot 22 for anchoring to the base 14 in such a manner as to allow downward deflection, but not upward raising.

As shown in FIG. 1, the elongated slots 22 form parallel rows that are oriented perpendicular to the floorboards of the wear layer 12. In this configuration, the slots 22 are oriented at an oblique angle about 30° relative to the lengths of the panels 20, which means that the panels 20 are oriented at an angle of about 60° relative to the floorboards. FIG. 1 shows more than one slot 22 per panel 20, and specifically four slots 22 per each full length panel 20. However, relative to the direction of the floorboards, none of the slots 22 of any given panel 20 are contiguous. Stated otherwise, the lengths of the angled slots 22 are such that there is no overlap along the longitudinal direction of the floorboards.

The elongated slots 22 do not necessarily need to be uniformly spaced. The elongated slots 22 are preferably oriented at an angle of about 30° relative to the length and/or grain of the respective subfloor panel 20. Such a configuration avoids possible weakening along an edge of the subfloor panel 20, which a grain-aligned elongated slot 22 might otherwise cause in isolated sections of the subfloor panel 20. The invention contemplates varying the angle of orientation for all or some of each elongated slot 22 of the floor, per the particular requirements of the floor installation. For example, a floor may include two sets of parallel slots aligned in different directions.

The elongated slots 22 may be fashioned in any shape that conforms with the principles of the invention, but are preferably elongated. As shown in FIG. 1, an exemplary elongated slot 22 has a horizontal dimension of about 16"–17" in length and about 2" in width, and is counterbored so as to have two opposing ledges 40 that extend horizontally along the longitudinal sides of the slot 22. The ledge 40 may have a depth of about ¼"–¾" as measured from a top surface 42 of the panel 20 and a width of about ⅜".

The longitudinal dimensions of the slots 22 are oversized with respect to the longitudinal dimensions of the elongated fasteners 24. For instance, a gap 44 preferably exists between the respective longitudinal ends of each elongated fastener 24 and the respective slot 22. This longitudinal oversizing allows relative lateral, or horizontal, movement between the upper floorboards and the base along the slots. Such movement may be caused by sheer forces due to expansion or contraction of the wood, which is attributable to moisture ontake or egress. The elongated slots 22 are further shaped to receive therein the elongated fasteners 24. Each elongated fastener 24 may include multiple pre-drilled holes 50 to facilitate anchoring to the base 14.

Figure 3:
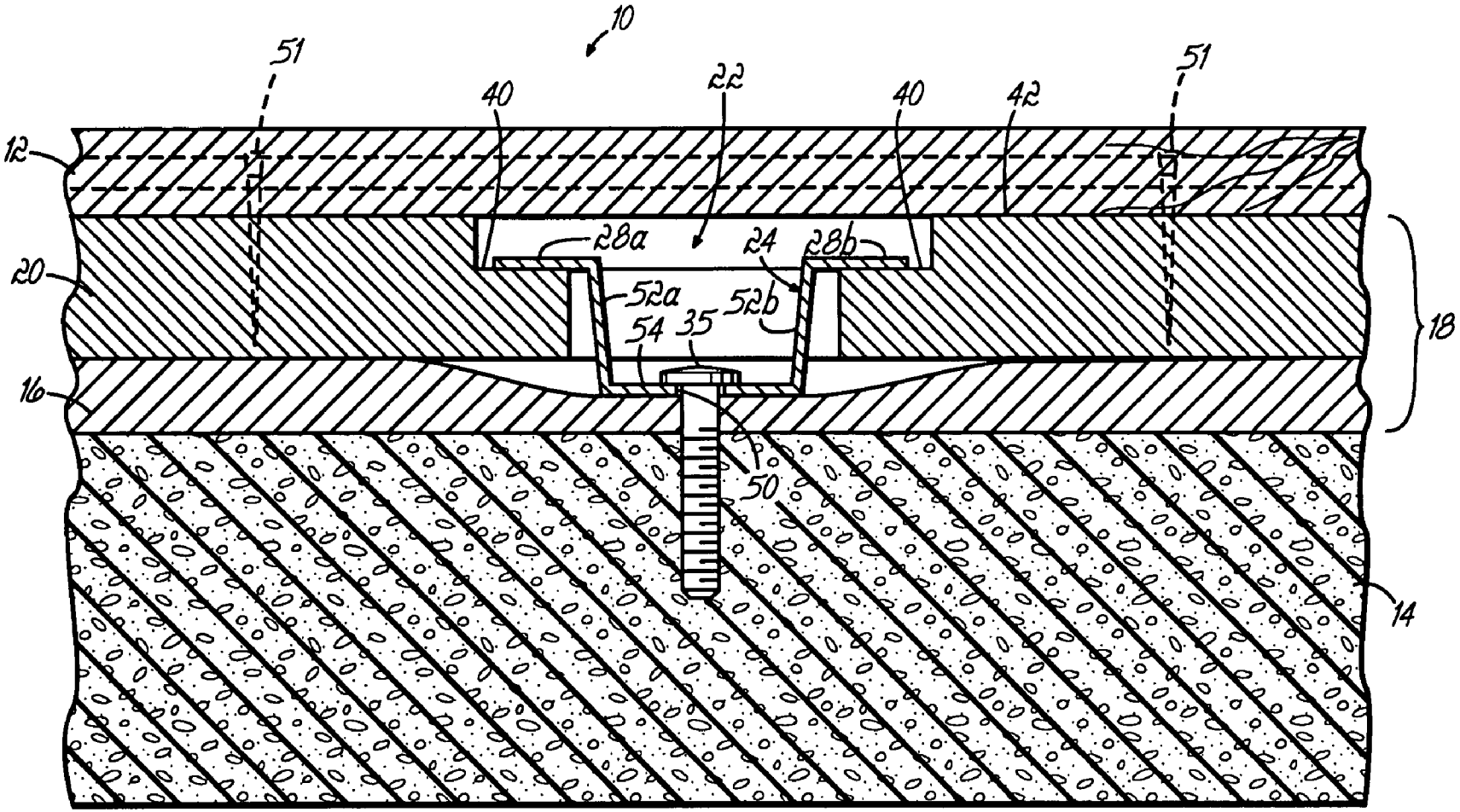
FIG. 3 is a cross sectional view of the floor of FIG. 1, taken along lines 3—3 of FIG. 2.

FIG. 3 shows more specific details of the elongated fasteners 24. Essentially, each fastener 24 comprises an elongated U-shaped channel with a bottom section 54, two generally vertical sidewalls 52*a* and 52*b*, and two oppositely directed flanges 28*a* and 28*b*, which are substantially horizontal. The flanges 28*a* and 28*b* cooperate with ledges 40 of the respective slot 22 to hold down the respective panel 20.

This structure makes it easy for an installer to drive an anchor pin 35 into the base 14, so that the flanges 28*a* and 28*b* hold down the subfloor panel 20. The horizontal flanges 28*a* and 28*b*, however, do not prevent movement in the horizontal direction. As such, the subfloor panel 20 may advantageously slide under the flanges 28*a* and 28*b* to accommodate sheer forces. The above discussed oversizing of the elongated slots 22 thus permits the entire substructure assembly 15 limited movement independent of the anchor pins 35.

Also, the slot 22 is preferably oversized in transverse cross section, as shown in FIG. 3. This helps the floor accommodate sheer forces or movement along the transverse direction. It also allows a lower tolerance to be used in forming the slots 22. Perhaps more importantly, the oversizing in the transverse and longitudinal directions provides additional freedom of movement, which leads to another benefit. More specifically, with the preferable construction of only one anchor pin 35 for securement of each elongated fastener 24, each fastener 24 has only a single anchor point. Thus, each elongated slot 22 functions as an individual pivot, thereby allowing, in a collective sense, the entire floor 10 to self-align. This self-alignment floor stabilization feature, which results from longitudinal and transverse oversizing of the slots 22 in combination with the single anchor points, mitigates the effects of binding and other imprecisions that can occur during floor installation.

FIG. 2 shows an exemplary anchoring mechanism, namely a pin 35. Other suitable anchoring mechanisms could include adhesive, screws, staples, nails and/or any conventional fastening mechanisms known in the field. If desired, the anchoring mechanism may include some physical structure or method to prevent pre-compression of the spacer layer 16 during installation, as taught in the above-mentioned '380 and '000 patents.

FIG. 3 shows oppositely directed flanges 28*a* and 28*b* holding down the panel 20 at the ledges 40 of the slot 22. As shown, the elongated fastener 24 compresses a portion of the panel-like spacer layer 16 that resides therebelow. The elongated fastener 24 preferably has dimensions of about 2¼" by about 12", with two generally vertical sidewalls 52*a* and 52*b* that each extend upwardly at a slight outward angle from the bottom horizontal section 54. The outward angle may be configured to absorb stresses and provide lateral give to the floor 10. The upper ends of the sidewalls 52*a* and 52*b* terminate at the horizontal flanges 28*a* and 28*b*, which extend outwardly in the horizontal direction to overlap respective outer ledges 40 of the elongated slot 22.

Figure 4:
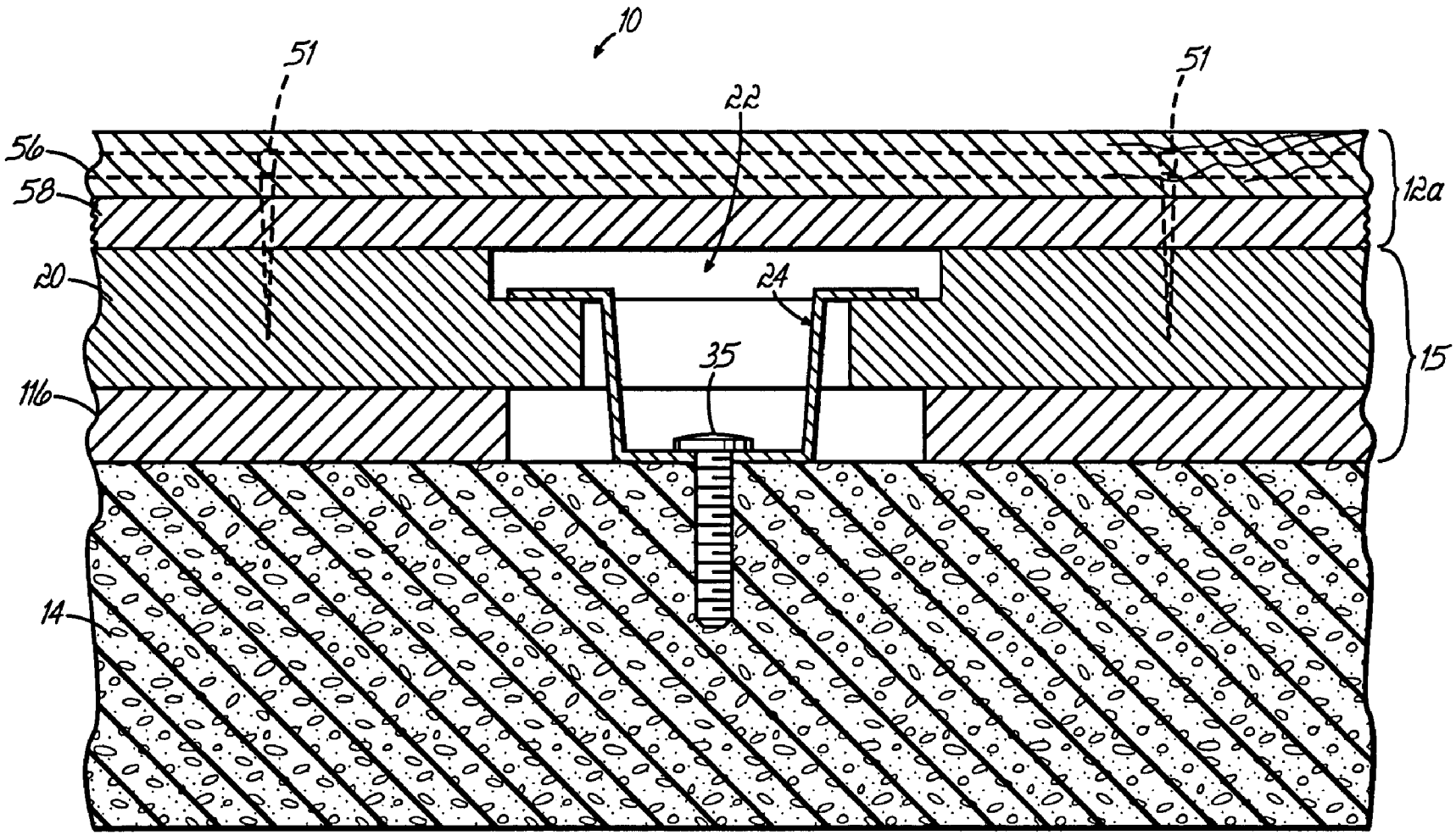
FIG. 4 is a cross sectional view, similar to FIG. 3, showing of a variation of the present invention, with a non-compressible and discontinuous spacer layer.

The elongated fasteners 24 anchor the subfloor layer 15 to the base 14, but in a resilient manner. As a result, the wear layer 12 secured to subfloor layer 15 is also anchored and resilient. FIGS. 3 and 4 show, respectively, two variations on the preferred embodiment, wherein the spacer layer comprises a non-compressible panel type material 116, and wherein the spacer layer comprises a plurality of uniformly spaced and distributed pads 216. The rest of the structure is the same as described above with respect to FIGS. 1 and 2.

Figure 5:
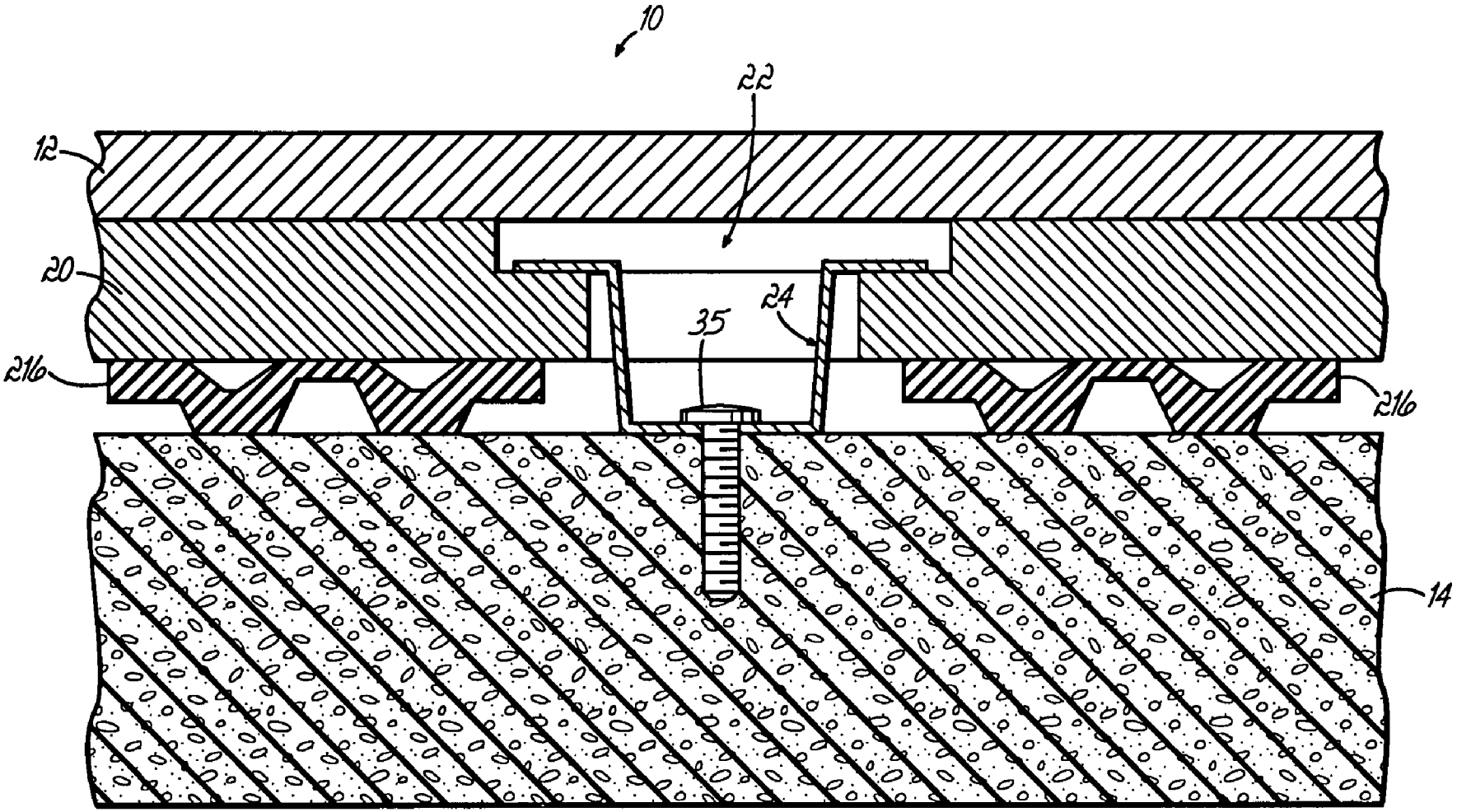
FIG. 5 is a cross sectional view, similar to FIGS. 3 and 4, showing of another variation of the present invention with a discontinuous spacer layer comprising a plurality of discrete pads.

To install the floor of this invention, a user rolls out a plurality of spacers 16, which may be carpet, foam, laminate, polymer, pads, cloth, rubber or any other material having a resilient or other quality that permits a desired degree of downward deflection of the wear layer 12 upon impact. For instance, a suitable spacer layer 216 may comprise compressible pads as shown in FIG. 5. It may be desired to readily blanket the base 14 in one application, while in another case, the spacer layer 16 may be elongated, as in FIGS. 3 and 4. Discontinuous pads or carpet pieces may be arranged as desired, and may be spaced laterally from the anchor pins 35. One of skill in the art should appreciate that selection of the material, placement and dimensions of the spacers 16 may vary per acoustical and vibrations considerations specific to an installation site.

An installer next places the panels 20 on top of the spacer layer 16. The panels 20 may be conventional in size, but are preferably either four or eight feet in length, one or two feet in width, and have a uniform thickness of about ¾". One of skill in the art will appreciate that an installer will include spacing (not shown) on the order of a fraction of an inch in between adjacent panels 20 per industry requirements. Each subfloor panel 20 includes a plurality of uniformly spaced, elongated slots 22, each sized and shaped to receive an elongated fastener 24 to hold the panel 20 to the base 14. A two foot-by-four foot subfloor panel 20 may include two-to-three elongated slots 22. As shown in FIG. 1, an exemplary two foot-by-eight foot subfloor panel 20 may include four-to-five elongated slots 22.

Thereafter, the elongated fasteners 24 are placed in the slots 22, and anchor pins 35 are driven through the bottoms 54 of the fasteners 24 and into the base 14 to hold the subfloor layer 15 in place. Preferably, the slots 22 are transversely and longitudinally oversized in relation to the fasteners 24 and only one pin 35 is used per fasteners 24. As a result, and after the wear layer 12 is secured on top, the resulting floor 10 is self-aligning in response to lateral sheer forces.

Compared to prior anchored/resilient floors, and particularly panel-type floors, the present floor 10 is relatively simple to install and can be done so at a relatively low cost. Even compared to other free floating hardwood floors, or other anchored floors that may have little or no resilience, the present invention represents a significant number of advantages to the end user, primarily due to the achievement of a uniformly stable and structurally strong panel-type subfloor, with relatively low installation, handling and material costs. The present invention further achieves a self-alignment capability that makes the floor less susceptible to various sheer forces.

Figure 6:
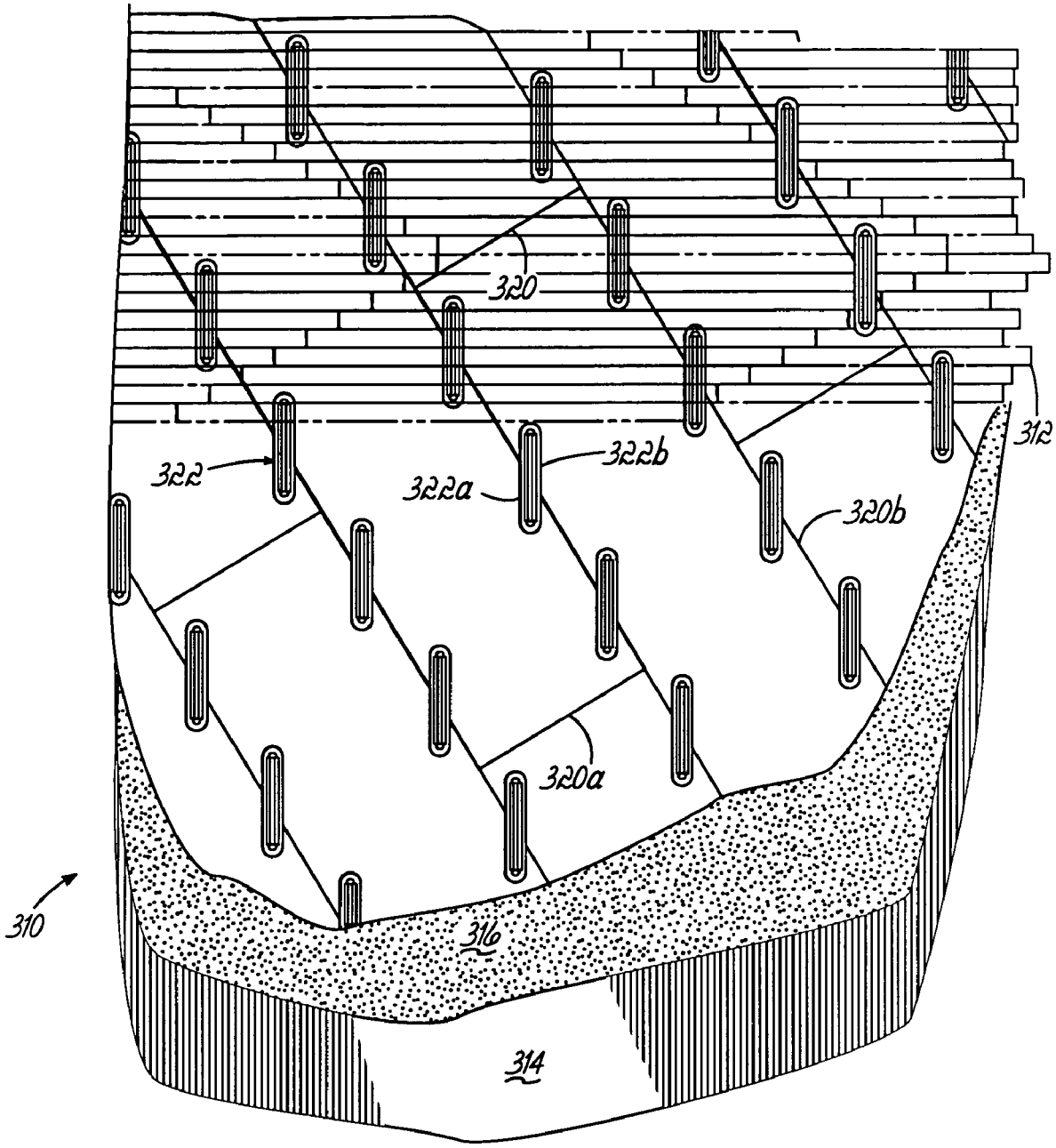
FIG. 6 is a plan view showing an anchored/resilient floor according to a second preferred embodiment of the invention, with some of the slots formed by adjacently located panels.

In another preferred embodiment, FIG. 6 shows a plan view of a floor 310 comprising a plurality of panels 320 that reside below a wear layer 312 and above a base 314. The panels 320 are arranged end-to-end in parallel rows along an axis that resides at an angle of about 60° relative to the floorboards of the wear layer 312. The wear layer 312 is supported in spaced relation above the base 314, with a spacer layer 316 residing therebetween.

Each of the panels 320 includes at least a portion of an elongated slot 322, or open-ended slot portion 322*a*, formed in the panel 320*a*. As shown in FIG. 6, an open-ended slot portion 322*a* of a first panel 320*a* aligns with a complementary open-ended portion 322*b* of slot 322 of an adjacent panel 320*b*. The resultant elongated slot 322 is oriented at about a 30° angle relative to the length and/or grain of its respective panels 320*a* and 320*b* as shown in the embodiment of FIG. 6. An elongated fastener 324 located within the elongated slot 322 anchors to the base 314 in such a manner as to allow downward deflection, but not upward raising. Adjoining portions of open-ended slot portions 322*a* and 322*b* combine to form an elongated slot 322. This feature assures continuity where respective, adjacent panels 320*a* and 320*b* abut. Securing two such open-ended slots of an elongated slot 322 further facilitates better uniformity of resiliency and superior stabilization.

Figure 7:
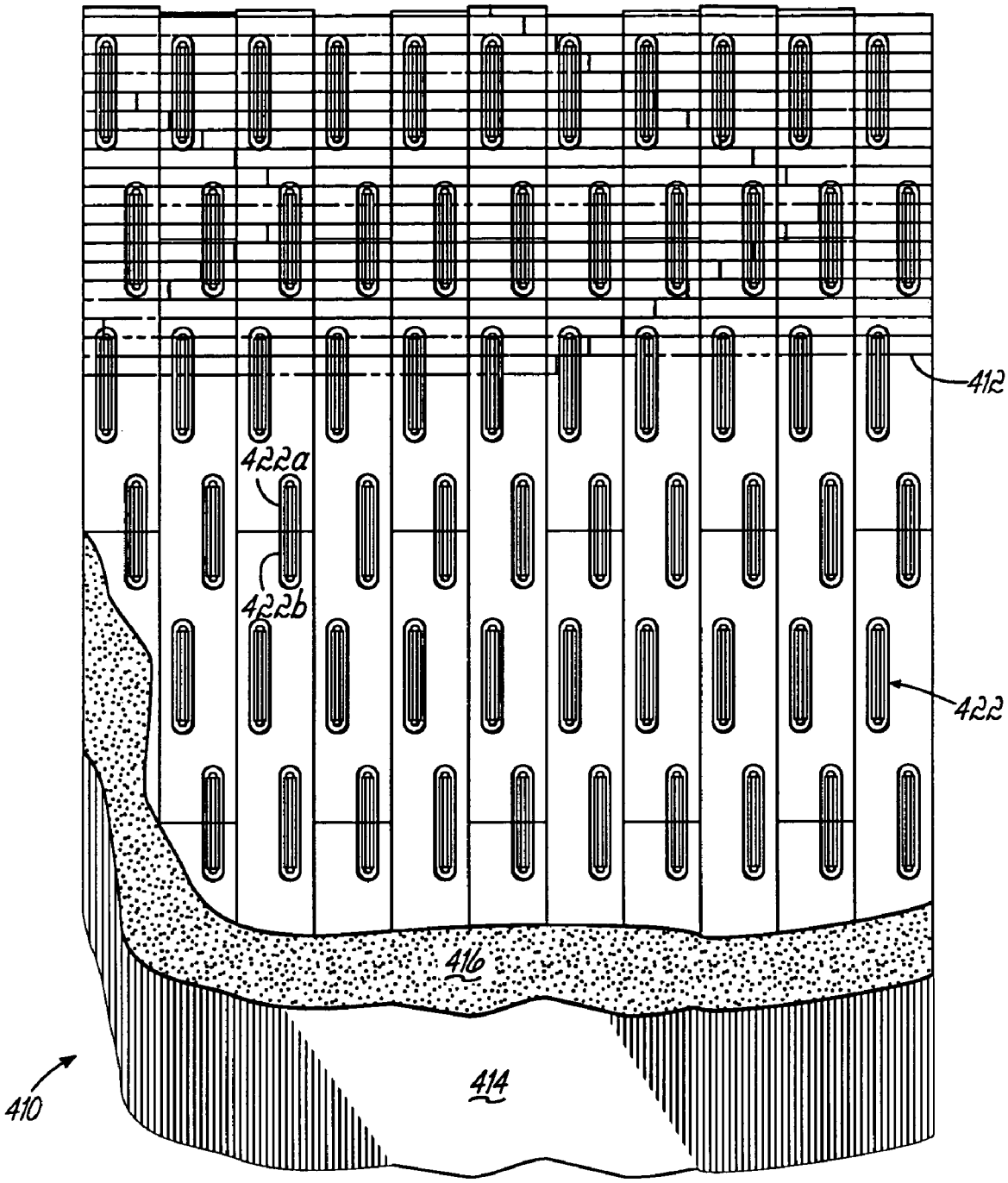
FIG. 7 is a plan view showing an anchored/resilient floor according to a third preferred embodiment of the invention, with the panels further elongated and the slots and panels extending along the same direction.

FIG. 7 shows another preferred embodiment having elongated slots 422 in accordance with the principles of the present invention. Where advantageous, the elongated slots 422 comprise open-ended slots 422*a* and 422*b* as discussed above. The elongated slots 422 are preferably oriented generally along the length and/or grain of a respective subfloor panel(s) 420. Alignment of the elongated slots 422 may simplify installation at certain sites. The elongated slots 422 do not necessarily need to be uniformly spaced and may be staggered as show in FIG. 7. Stated otherwise, at least one slot 422 is laterally offset from the direction of the rows of panels 420. This staggering of the elongated slots 422 may help ensure failsafe anchoring along the control/construction joints of the concrete slabs that comprise the base 414. Of note, the panels 420 shown in FIG. 7 are approximately one foot in width for industry standard performance and contouring considerations.

Figure 8:
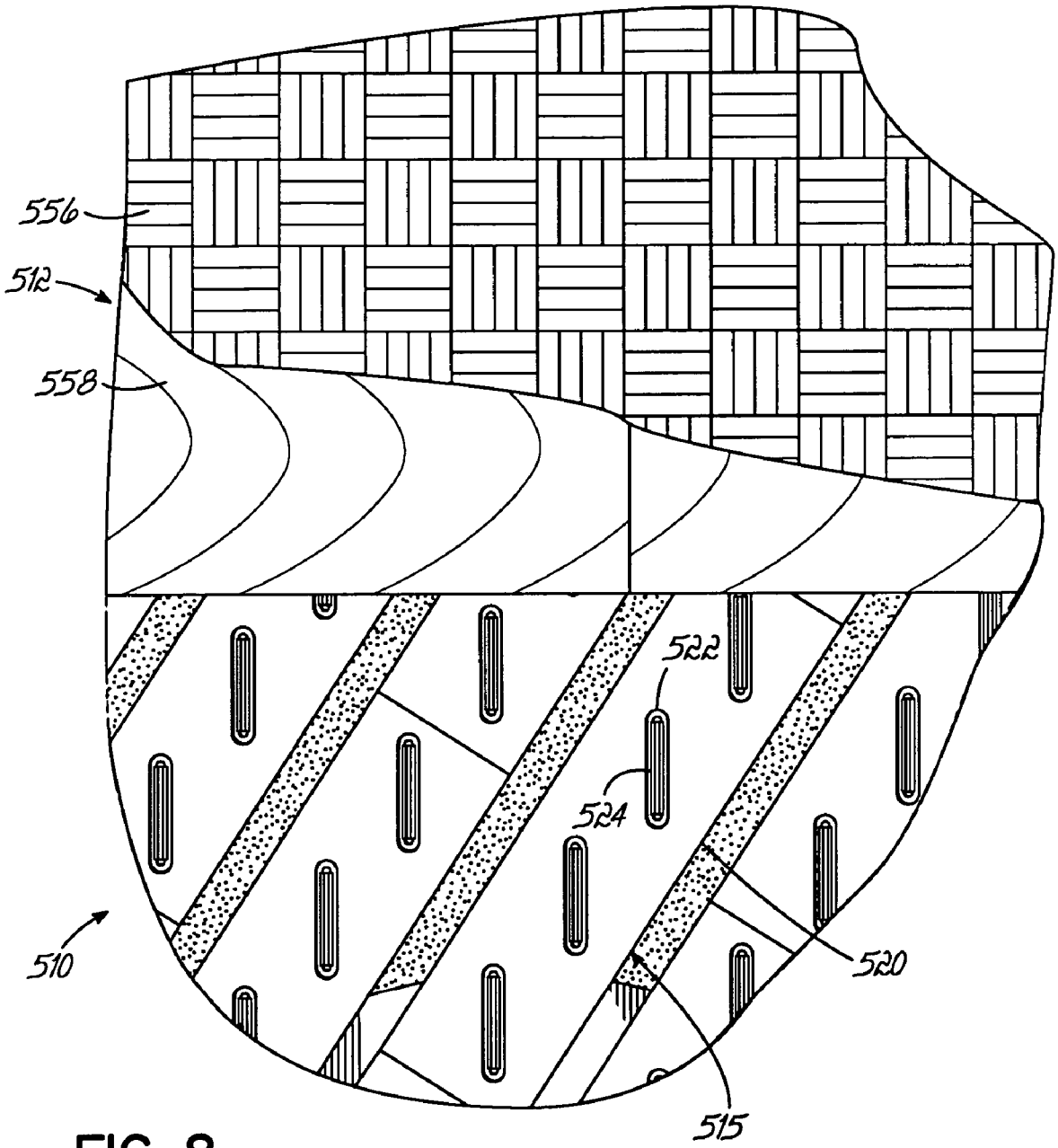
FIG. 8 is a plan view showing an anchored/resilient floor according to a fourth preferred embodiment of the invention, that is similar to the first preferred embodiment, but with greater spacing between adjacently located rows of panels.

FIG. 8 shows a plan view of a floor 510 constructed in accordance with another preferred embodiment of the invention. The floor 510 includes an upper wear layer 512 that may comprise a plywood sublayer 58/558 and a surface layer 56/556, as shown in both FIGS. 4 and 8, respectively. An exemplary surface layer 556 may include nonstructural material such as rubber or plastic, as well as parquet flooring or another type of sportwood. The continuous plywood sublayer 558 of the wear layer thus provides support for the surface layer 556.

A subfloor layer 515 comprising a plurality of panels 520 resides below the wear layer 512. The panels 520 are arranged end-to-end in parallel rows. As shown in FIG. 8, the subfloor panels 520 may be transversely spaced relative to one another. This spacing between parallel rows may be at least a quarter of the width of a panel 520. Such spacing may reduce squeaking and minimize material costs. Where desired, each of the panels 520 includes at least one elongated slot 22 formed in the panel 520 and oriented at about a 30° angle relative to the length and/or grain of its respective panel 520. An elongated fastener 524 located within the elongated slot 522 anchors to a base 514 in such a manner as to allow downward deflection, but not upward raising.

While this application describes one presently preferred embodiment of this invention and several variations of that preferred embodiment, those skilled in the art will readily appreciate that the invention is susceptible to a number of additional structural variations from the particular details shown and described herein. For instance, the particular structure and/or arrangement of the spacer layer 16, the panels 20 of the subfloor layer 15 and the types and/or locations of the anchor pins 35 may be reoriented or rearranged to achieve the benefits of the present invention. Moreover, different features of the embodiments of FIGS. 1–8 may be selectively combined to realize other embodiments in accordance with the principles of the present invention. Therefore, it is to be understood that the invention in its broader aspects is not limited to the specific details of the embodiment shown and described. The embodiments specifically shown and described are not meant to limit in any way or to restrict the scope of the appended claims.

We claim:

1. An anchored/resilient floor comprising:

an upper wear surface residing over a base;

a subfloor layer of panels supporting the upper wear surface over the base, the panels arranged end-to-end in parallel rows oriented in a first direction;

a spacer layer supporting the subfloor layer a desired distance above the base; and a plurality of fasteners comprising two opposing outwardly extending flanges, the fasteners holding the subfloor layer of panels at the desired distance above the base, such that the held panels have a predetermined number of elongated slots and the fasteners cooperate with the slots to hold the panels to the base, the slots aligned in parallel rows along a second direction that is oriented at an oblique angle relative to the first direction, whereby the orientation of the panels in the first direction relative to the orientation of the slots in the second direction, enhances the structural integrity of the floor.

2. The anchored/resilient floor of claim 1 wherein the upper wear surface further comprises a plurality of floorboards, and each floorboard has a tongue and groove configuration.

3. The anchored/resilient floor of claim 1 wherein the upper wear surface further comprises plurality of floorboards laid end-to-end in parallel rows that are aligned along a third direction that is perpendicular to the second direction.

4. The anchored/resilient floor of claim 1 wherein, the slots are counterbored to define ledges that contact the flanges, thereby to hold the panel to the base along the two opposing ledges of the slot.

5. The anchored/resilient floor of claim 1 wherein the spacer layer comprises a compressible pad that substantially covers and contacts the base.

6. The anchored/resilient floor system of claim 1 wherein at least some of the panels have more than one slot.

7. The anchored/resilient floor system of claim 6 wherein for the panels that have more than one slot, said slots are parallel and are not coextensive in a direction perpendicular to the second direction.

8. The anchored/resilient floor of claim 1 wherein the lengths of the slots are oversized relative to the fasteners, thereby to permit lateral movement of the wear surface and the panels relative to the base along the second direction.

9. The anchored/resilient floor of claim 1 wherein the fasteners comprise an anchor pin, whereby the longitudinal and transverse oversizing of the slot and the pin allows the floor to self-align in response to lateral forces, thereby to enhance the overall structural integrity of the floor.

10. The anchored/resilient floor of claim 1 wherein the subfloor layer of panels results in a plurality of aligned and parallel rows of elongated slots oriented in the second direction.

11. The anchored/resilient floor of claim 1 wherein at least some of the slots are defined by complementary open-ended slot portions of two adjacently located panels.

12. A subfloor for an anchored/resilient floor comprising:

a panel supported above a base, the panel having a first longitudinal direction and at least one elongated slot formed therein that is open to the base, said at least one slot oriented at an oblique angle relative to the first direction;

a spacer supporting the panel a desired distance above the base; and for each of the slots, a fastener supported on the spacer and cooperating with opposing longitudinal edges of the respective slot to hold the panel to the base, the slot being longitudinally and transversely oversized relative to the fastener, thereby to accommodate sheer forces and enhance the structural integrity of the subfloor.

13. The subfloor of claim 12, wherein each fastener further comprises an anchor pin, whereby the longitudinal and transverse oversizing of the slots relative to the fastener allows the floor to self-align in response to lateral forces, thereby to enhance the overall structural integrity of the floor.

14. An anchored/resilient floor comprising:

an upper wear surface residing over a base;

a subfloor layer of panels supporting the upper wear surface over the base, the panels arranged end-to-end in parallel rows oriented in a first direction;

a spacer layer supporting the subfloor layer a desired distance above the base;

a plurality of fasteners comprising two opposing outwardly extending flanges, the fasteners holding the subfloor layer of panels at the desired distance above the base, such that each of the held panels has a predetermined number of elongated slots and the fasteners cooperate with the slots to hold the panels to the base along first and second sides of the slot, the slots aligned in parallel rows along the first direction; and a plurality of anchor pins, wherein at least one anchor pin of the plurality holds a fastener to the base.

15. The anchored/resilient floor of claim 14 wherein the upper wear surface further comprises a plywood sublayer.

16. The anchored/resilient floor of claim 14 wherein the slots are counterbored to define ledges that contact the flanges, thereby to hold the panel to the base along the two opposing ledges of the slot.

17. The anchored/resilient floor of claim 14 wherein, for each of the rows of panels, at least one of the slots is longitudinally offset relative to the first direction.

18. The anchored/resilient floor of claim 14 wherein each of the fasteners further comprises an anchor pin, whereby the longitudinal and transverse oversizing of each slot with respect to each fastener allows the floor to self-align in response to lateral forces, thereby to enhance the overall structural integrity of the floor.

* * * * *